United States Patent [19]

Mattis

[11] Patent Number: 4,696,532

[45] Date of Patent: Sep. 29, 1987

[54] CENTER CONDUCTOR SEIZURE

[75] Inventor: John S. Mattis, Sunnyvale, Calif.

[73] Assignee: Raychem Corp., Menlo Park, Calif.

[21] Appl. No.: 677,155

[22] Filed: Dec. 3, 1984

[51] Int. Cl.[4] ..... H01R 4/50; H01R 17/04

[52] U.S. Cl. ..... 439/863; 439/585

[58] Field of Search ..... 339/273 R, 273 F, 273 S, 339/177 E, 177 R

[56] References Cited

U.S. PATENT DOCUMENTS

| | | | |
|---|---|---|---|
| 3,474,391 | 10/1969 | Gartzke et al. | 339/177 E |
| 3,671,926 | 6/1972 | Nepovim | 339/273 R |
| 3,678,446 | 7/1972 | Siebelist | 339/177 E |
| 3,757,279 | 9/1973 | Winston | 339/177 R |
| 3,761,870 | 9/1973 | Drezin et al. | 339/273 R |
| 4,362,352 | 12/1982 | Hawkins et al. | 339/273 S |
| 4,491,685 | 1/1985 | Drew et al. | 339/177 E |

FOREIGN PATENT DOCUMENTS

| | | | |
|---|---|---|---|
| 2409685 | 9/1974 | Fed. Rep. of Germany | 339/273 S |
| 2415590 | 10/1974 | Fed. Rep. of Germany | 339/177 R |

*Primary Examiner*—Gil Weidenfeld
*Assistant Examiner*—Gary F. Paumen
*Attorney, Agent, or Firm*—Dennis E. Kovach; Herbert G. Burkard

[57] ABSTRACT

An apparatus for terminating a coaxial cable includes a connection pin and a spring sleeve having first and second spring portions, the first spring portion receiving one end of the connection pin and the second spring portion receiving an end of a center conductor of the coaxial cable. The second spring portion has a conical outer surface received within a conical hole of a sleeve held in place by first and second connector bodies, the sleeve increasing a clamping force of the second spring portion on the center conductor when the center conductor is subjected to pull-out load.

8 Claims, 1 Drawing Figure

CENTER CONDUCTOR SEIZURE

BACKGROUND OF THE INVENTION

The present invention relates to an apparatus for connecting a coaxial cable to a junction box, possibly a drop wire splice box, the coaxial cable including a center conductor and metallic shield therearound. Since coaxial cables are oftentimes placed under load subsequent to being terminated, such as to a junction box, it is required to securely fasten the coaxial cable upon termination so as to withstand any pull-out force exerted thereon. Typical pull-out forces occur due to temperature changes which cause thermal expansion and contraction of the coaxial cable, forces generated by wind, impact forces directly on the cable from miscellaneous objects, etc.

Prior art apparatuses for connecting a coaxial cable to a junction box include means for securely connecting a center conductor of the coaxial cable to the junction box so that the load generated by the various forces described above are primarily imposed upon the center conductor which is often made of a relatively strong metal member most capable of withstanding stress. According to these apparatuses, a connection pin is contained within a housing so that a first end of the connection pin can be secured to the junction box in a manner well known in the art. A second end of the connection pin opposite the first end has a cylindrical gripper formed thereon for receiving an end of the center conductor of the coaxial cable to be terminated. First and second insulating sleeves having mating conical surfaces are disposed around the gripper, with an inner one of these sleeves being compressed radially inward upon the gripper when the first and second sleeves are moved towards one another. A housing comprises first and second housing members threadably engaged. As the first and second housing members are tightened via the threads, the first and second sleeves move toward one another which compresses the gripper around the center conductor.

With such a construction, a center conductor of a coaxial cable can easily be inserted into the gripper of the connector pin at the second end thereof by maintaining the first and second housing members loosely connected. Subsequent to inserting the center conductor within the cylindrical gripper, a craftsman then proceeds to turn the first housing member relative to the second housing member with a wrench causing the first and second sleeves to move toward one another and cause the gripper to radially clamp down and be secured to the center conductor.

Such an apparatus is disadvantageous since it is oftentimes difficult to turn the first and second housing members relative to one another in the field, especially in bad weather situations, and the craftsman oftentimes does not know when the gripper is exerting an optimum amount of clamping force on the end of the center conductor. Accordingly, oftentimes the center conductor is not adequately clamped to the connection pin resulting in premature pull-out of the center conductor when subjected to axial forces and loads.

SUMMARY OF THE INVENTION

It is an object of the present invention to eliminate the above-described difficulties, and to provide an apparatus which is much less craft-sensitive than prior art apparatuses for connecting a center conductor of a coxial cable to a connection pin which is secured to a termination box.

These and other objects are achieved by the provision of a spring sleeve having first and second spring portions at opposite axial ends thereof which have different spring constants, the first spring portion being engagable with the connector pin and the second spring portion being engagable with a center conductor of a coaxial cable, and by the provision of means for automatically clamping down on the second spring means, the automatically clamping-down means being activated by any pull-out force exerted on the center conductor.

BRIEF DESCRIPTION OF THE DRAWING

The FIGURE is a partial cross-sectional view of one embodiment of the present invention.

DESCRIPTION OF THE PREFERRED EMBODIMENTS

Figure 1:
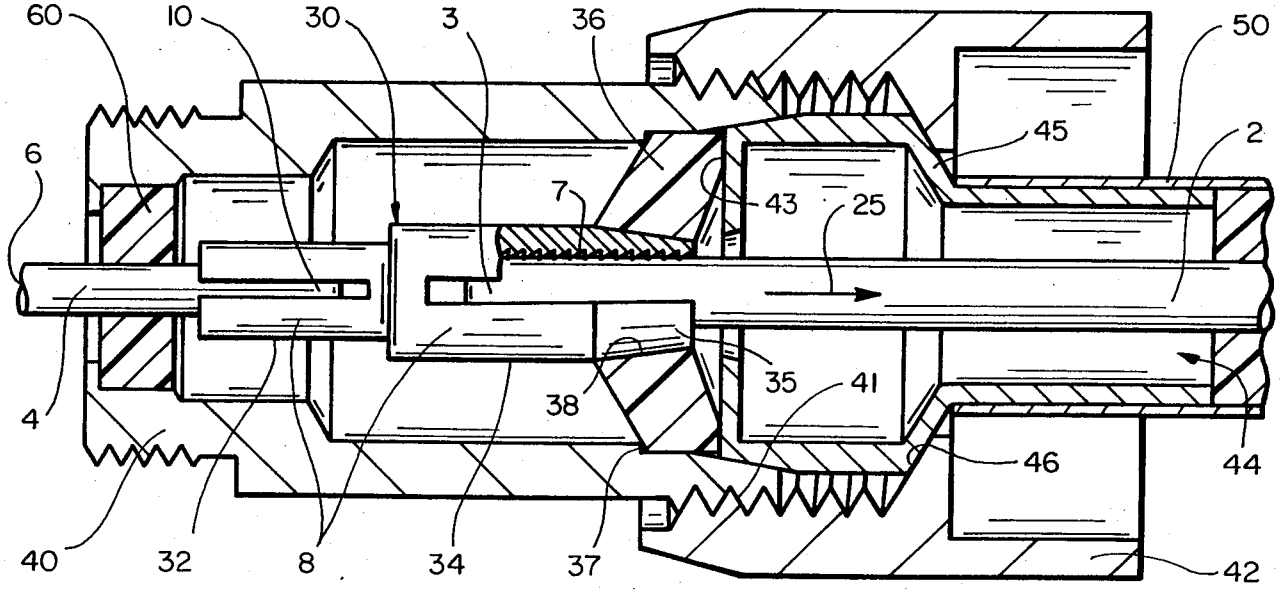

Referring to FIG. 1, the apparatus of the present invention includes a connection pin 4 which has an end 6 capable of being connected to a junction box, drop box, etc., and an axial spring sleeve 30 (shown partially in section) having first and second spring portions 32, 34 on opposite axial ends thereof. Preferably a spring constant of the first spring portion 32 is less than a spring constant of the second spring portion 34, with the first spring portion 32 being disposed around an end 10 of the connection pin opposite the end 6 which is connected to a termination box. Each spring portion preferably includes a plurality of spring legs 8. The legs 8 of the second spring portion preferably have screw-tooth-shaped teeth 7 formed thereon oriented as shown in FIG. 1, which teeth resist movement of end 3 of center conductor 2 in the direction of arrow 25 relative to the second spring portion 34. The legs 8 of the first spring portion 32 preferably do not have teeth formed thereon since a small relative movement between the connection pin and the portion 32 is desirable when axial force is exerted on the center conductor, as is more fully explained below.

A conical sleeve 36 having a conically shaped hole 38 therein is disposed around a conical section 35 of the second spring portion 34 of the axially extending spring sleeve 30. First and second connector bodies 40, 42, comprising an exterior portion of the apparatus, are threadably engaged via threads 41 such that the sleeve 36 is disposed around the conical section 35 of the second spring portion 34 so that the hole 38 does not significantly compress the second spring portion along a direction radially inward. The sleeve 36 is maintained in place by a shoulder 37 of the connector body 40, and by a shoulder 43 of a shield member 45. An opposite end of the shield member 45 is maintained is place by a third shoulder 46 of the connector body 42. Reference numeral 60 is an environmental seal. In use, an EMI shield 50 of the coaxial cable, is received around the shield member 45, as illustrated, subsequent to coring a dielectric from an end of the coaxial cable being terminated.

In operation, a craftsman simply inserts a center conductor 2 through an end 44 of the apparatus in line with an axis of the second spring portion 34 with a force sufficient to insert an end 3 of the center conductor within the second spring portion, e.g., the spring legs 8 comprising the second spring portion are slightly deflected outwards by the inserting force. With such a construction, subsequent to inserting the end 3 of the center conductor as described, if a force along an arrow 25 is exerted on the coaxial cable so as to induce movement of the center conductor along the direction of the arrow 25, the sleeve 30 is likewise caused to move in the direction of the arrow 25 since the spring constant of the first spring portion 32 clamping the connection pin 4 is less than the spring constant of the second spring portion 34 clamping the center conductor 2 and/or since the teeth 7 prevent relative movement between the center conductor and the spring portion 34 and the absence of teeth on the spring portion 32 encourages movement between the portion 32 and the connection pin 4.

As the sleeve 30 moves in the direction of the arrow 25, the spring legs 8 of the second spring portion 34 are caused to be forced radially inward by the engagement of the hole 38 of the sleeve 36 with the conical section 35, thus increasing a gripping force of the second spring portion 34 on the end 3 of the center conductor. This increased gripping force is sufficiently large so as to positively prevent the end 3 of the center conductor 2 from being removed from the second spring portion 34. Since axial movement of the sleeve 30 along the direction of the arrow 25 is limited due to the interengagement of the housing members 40, 42, sleeve 36, and shield member 45, the first spring portion 32 remains in contact with the conductor pin 4 and continuous electrical connection results. Tests have shown that the apparatus works so well that the center conductor 2 fails in tension prior to being separated from the second spring portion 34 and prior to electrical disconnection between the conductor pin 4 and the center conductor 2.

The invention is especially well suited for terminating coaxial cables such as those described in copending Ser. Nos. 531,961 filed Sept. 14, 1983 and 594,628 filed Mar. 29, 1984, both assigned to the assignee of the present invention, these disclosures being incorporated herein by reference, the terminations generally being at junction and drop wire boxes.

Though the invention has been described by reference to one particular embodiment thereof, it should be understood modifications thereto can be made without departing from the spirit and scope of the present invention, the invention being limited only by the appended claims.

What is claimed is:

1. An apparatus for terminating a conductor, comprising:

a spring sleeve having first and second spring portions sized to receive a connection pin and the conductor respectively therein, the first and second spring portions being constructed such that a pull-out clamping force exerted on the connection pin by the first spring portion is less than a pull-out clamping force exerted on the conductor by the second spring portion, said second spring portion having a conical outer surface on one end thereof; and means for engaging said conical outer surface such that movement of said spring sleeve relative to said engaging means along a predetermined direction increases said clamping force on said conductor, the connection pin being fixed and contained within the first spring portion of the spring sleeve, the spring sleeve being preferentially moveable relative to the connection pin rather than the conductor when the conductor is urged axially away from the connection pin.

2. The apparatus as claimed in claim 1, at least one of said first and second spring portions comprising a plurality of longitudinally extending spring legs.

3. The apparatus as claimed in claim 2, said spring legs of said second spring portion engaging said conductor having having a plurality of teeth formed thereon for engaging said conductor.

4. The apparatus as claimed in claim 1, further comprising first and second connector bodies for holding and limiting axial movement of said engaging means and said spring sleeve, the second spring portion being sized and constructed such that the conductor is insertable into the second spring portion subsequent to the first and second connector bodies being completely assembled.

5. The apparatus as claimed in claim 4, further comprising a metal shield disposed on a side of said engaging means opposite said second spring portion, said conductor comprising a center conductor of a coaxial cable, said metal shield being adapted for receiving therearound a coaxial cable shield.

6. The apparatus as claimed in claim 1, said conductor comprising a center conductor of a coaxial cable, the connection pin being fixedly connected to a junction box or a drop box.

7. A method of making a termination for a center conductor of a coaxial cable, comprising the steps of:

disposing a first spring portion of a spring sleeve having the first and a second spring portion around a connection pin, said second spring portion being shaped so as to exert a clamping force on a center conductor inserted therein which is larger than the clamping force exerted by the first spring portion on the connection pin;

disposing a second sleeve around an outer conical surface of the second spring portion so as to increase said clamping force of said second spring portion when said second spring portion is moved in a direction opposite from said connection pin;

enclosing the spring sleeve and the second sleeve in their final assembled configuration in a housing such that the center conductor can thereafter be inserted into the second spring portion and be clamped thereby against removal therefrom without adjusting the housing; and inserting said center conductor into said second spring portion subsequent to enclosing the spring sleeve and the second sleeve in their final assembled configuration.

8. The method of claim 7, the connection pin being fixed to a junction box or drop box.

* * * * *